US005386758A

United States Patent [19]

Conley

[11] Patent Number: 5,386,758

[45] Date of Patent: Feb. 7, 1995

[54] APPARATUS AND METHOD FOR DISARMING PIPE BOMBS

[76] Inventor: Kenneth A. Conley, 1812 N. Timber, Bethany, Okla. 73008

[21] Appl. No.: 120,608

[22] Filed: Sep. 13, 1993

[51] Int. Cl.[6] ..... F42B 33/00

[52] U.S. Cl. ..... 86/50; 89/1.1

[58] Field of Search ..... 86/50; 89/1.1

[56] References Cited

U.S. PATENT DOCUMENTS

| | | | |
|---|---|---|---|
| 2,767,398 | 10/1956 | Pfaff et al. | 1/44.5 |
| 3,133,408 | 5/1964 | Stott | 60/26.1 |
| 3,150,560 | 9/1964 | Rosenthal | 89/1 |
| 3,481,143 | 12/1969 | Hsu | 60/26.1 |
| 4,046,055 | 9/1977 | McDanolds et al. | 86/1 B |
| 4,062,112 | 12/1977 | Lake | 30/228 |
| 4,779,511 | 10/1988 | Proctor et al. | 86/50 |
| 4,957,027 | 9/1990 | Cherry | 89/1.14 |
| 5,134,921 | 8/1992 | Breed et al. | 86/50 |
| 5,136,921 | 8/1992 | Büchel | 89/1.14 |
| 5,210,368 | 5/1993 | Heller, Jr. et al. | 86/50 |

FOREIGN PATENT DOCUMENTS

| | | |
|---|---|---|
| 998516 | 10/1976 | Canada . |
| 295784 | 8/1928 | United Kingdom . |

*Primary Examiner*—J. Woodrow Eldred

*Attorney, Agent, or Firm*—Dunlap, Codding & Lee

[57] ABSTRACT

A method and apparatus for disarming a pipe bomb wherein one of the end caps of the pipe bomb is knocked off with a sudden blow, such that the pipe bomb will be spun around somewhat in circles and the powder and/or contents employed in the bomb will be thrown out without detonation. The apparatus employs an explosively driven piston, acting like a hammer, with the explosive driving the piston, being detonated using a time delay fuse.

9 Claims, 1 Drawing Sheet

APPARATUS AND METHOD FOR DISARMING PIPE BOMBS

FIELD OF THE INVENTION

The present invention relates to devices and methods for disarming pipe bombs.

SUMMARY OF THE INVENTION

Safe disposal of explosive devices has long been a problem for law enforcement agencies. The increasing prevalence of simple explosive devices which may be constructed from common, inexpensive materials underscores the need for a safe method of disposal of such devices.

A pipe bomb is a common example of such an explosive device. Pipe bombs are normally comprised of a section of steel pipe filled with an explosive substance such as black powder, end caps which are threaded onto the ends of the pipe, and a device to detonate the bomb. A pipe bomb cannot simply be dismantled because of the great danger of inadvertently detonating the device. Since dismantling the pipe bomb is virtually impossible, the typical manner of disarming the pipe bomb is to relocate the pipe bomb to a remote area where it can be detonated. This method, however, does not eliminate the danger to property or human life. Additionally, the pipe bomb may include a mercury switch which will cause detonation of the pipe bomb upon even a very small change in position of the pipe bomb. This makes it even more difficult to transport a pie bomb to a disposal site.

The invention disclosed herein greatly increases the safety with which a pipe bomb may be disarmed. The disclosed apparatus may be used to strike one of the end caps of a pipe bomb with such force that the end cap is displaced away from the pipe bomb and the contents of the pipe bomb are dispersed. The pipe bomb is thereby rendered incapable of detonation. Since this method is initiated a safe distance from the pipe bomb, even if an explosion occurs there will be no harm to human life.

DESCRIPTION OF THE PREFERRED EMBODIMENT

Figure 1:
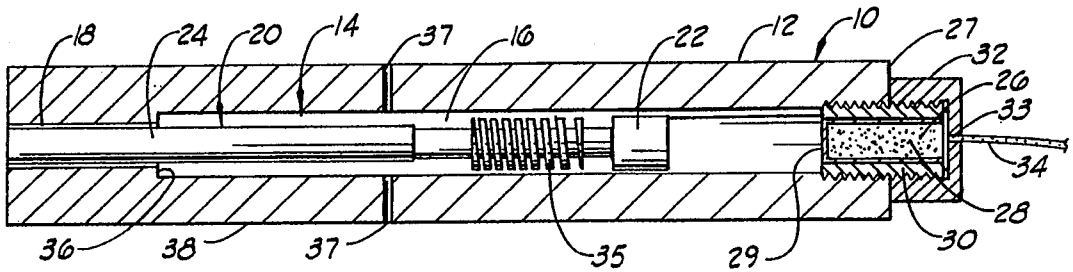
FIG. 1 is a cross-sectional view of the apparatus showing the placement of the piston before the apparatus has been activated.

Shown in FIG. 1 is an apparatus for disarming pipe bombs constructed in accordance with the present invention and designated by the general reference numeral 10. The apparatus 10 is comprised of a cylindrically shaped body 12 having a bore 14 extending therethrough wherein the bore 14 has a larger diameter portion 16 and a small diameter portion 18. A piston 20 is slidably disposed within the bore 14 of the body 12. The piston 20 has a larger diameter portion 22 having approximately the same diameter as the larger diameter portion 16 of the bore 14. The piston 20 has a smaller diameter portion 24 having approximately the same diameter as the smaller diameter portion 18 of the bore 14.

An explosive charge in the form of a shotgun shell 26 is located at the first end 27 of the body 12 inside cartridge holder 30. The shotgun shell 26 is prepared for use by emptying a normal shell of the usual pellets, wad, powder and primer. The shell 26 is then filled with black powder 28 (or equivalent) and the large open end is sealed by using hot glue, silicone 29 or other suitable means to keep moisture out.

The shotgun shell 26 is removably mounted in a cartridge holder 30 which is threadably secured in the end 27 of the body 12. An end cap 32 is threadably secured to the cartridge holder 30 to further secure the shotgun shell 26 within the body 12 and ensure that the explosive gases released from the shotgun shell 26 are released into the bore 14. The end cap 32 has a central bore 33 therethrough allowing a time fuse 34 to be extended from the shotgun shell 26 through the central bore 33. The time fuse 34 runs through the cap end of the shotgun shell 26 into the powder 28 and preferably sealed around the end of the shell 26 from which the time fuse 34 extends to keep out moisture.

Figure 2:
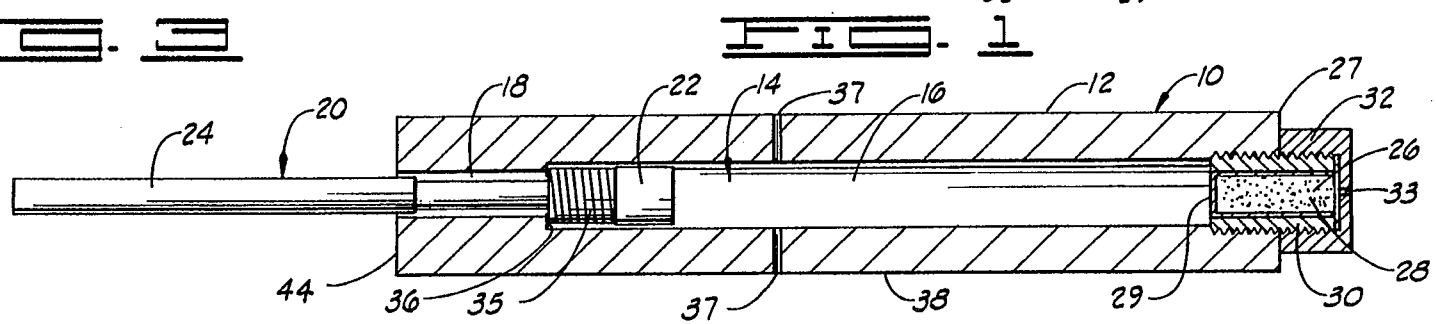
FIG. 2 is a cross-sectional view of the apparatus showing the placement of the piston after the apparatus has been activated.
Figure 4:
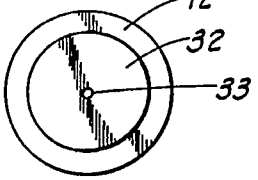
FIG. 4 is an end elevational view of the apparatus showing the end cap and the bore therethrough wherein a fuse may be received.
Figure 3:
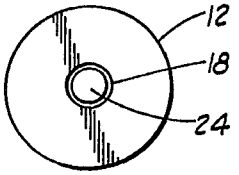
FIG. 3 is an end elevational view of the apparatus showing the piston disposed within the smaller diameter portion of the bore.
Figure 5:
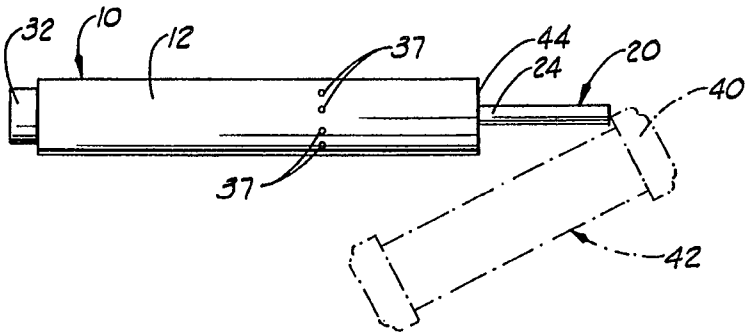
FIG. 5 shows the proper place of the apparatus in relation to a pipe bomb.

A coil spring 35 is disposed about the smaller diameter portion 24 of the piston 20 to relieve the impact to the end 36 of the larger diameter portion 16 of the bore 14 after the apparatus 10 has been activated. Vent apertures 37 extend from the bore 14 of the body 12 to the outer wall 38 of the body 12 whereby the explosive gases may be released into the atmosphere after the apparatus 10 has been activated. As shown in FIG. 2, the apertures 37 are positioned to be behind the piston 20 when the piston 20 strikes the inner end of end cap 40 of the pipe bomb 42 (FIG. 5) when the apparatus 10 is activated. The time fuse 34 is cut to a suitable length whereby the person who ignites the time fuse 34 will have sufficient time to retreat to a remote location to ensure his or her safety. The time fuse 34 is ignited and it burns until it detonates the powder in the shotgun shell 26 which discharges explosive gases into the bore 14 of the cylinder 12. The powder 28 acts as an explosive charge. The explosive gases force the piston 20 to slide down the bore 14 of the cylinder 12. As the piston 20 slides past the vent apertures 37, the explosive gases escape through the vent apertures 37 to the atmosphere. This prevents the explosive gases from escaping through the end of the apparatus 10 and igniting the dispersed contents (black powder or explosives) of the pipe bomb 42. Further, the vent apertures 37 are of a sufficiently small diameter to extinguish flames generated in the bore 14. The smaller diameter portion 24 of the piston 20 is extended out the end 44 of the cylinder 12 with sufficient force to dislocate an end cap 40 from the pipe bomb 42 (FIG. 5). As the end cap 40 is displaced, the force causes the pipe bomb 42 to spin about its transverse axis and the resultant centrifugal force causes the contents of the pipe bomb 42 to be dispersed, thus rendering the pipe bomb 42 incapable of detonation.

FIG. 2 shows the position of the components of the apparatus 10 after the apparatus 10 has been fired. The piston 20 has been forced down the length of the bore 14 to extend out the second end 44 of the body 12 and the coil spring 35 is compressed. As the pressure behind (to the right as shown in FIG. 2) the piston 20 is released, the coil spring 35 returns the piston to its starting position shown in FIG. 1. The end cap 32, the spent shotgun shell 26 and the cartridge holder 30 may then be removed to facilitate cleaning of the apparatus 10.

What is claimed is:

1. A method for disarming a pipe bomb having at least one end cap comprising the steps of:

locating the pipe bomb with an end cap exposed; then striking the exposed end cap of the pipe bomb with sufficient force to suddenly displace the end cap away from the pipe bomb, thereby dispersing the contents of the pipe bomb and rendering the pipe bomb incapable of detonation.

2. A method for disarming a pipe bomb having at least one end cap comprising the steps of:

striking the inner end of the exposed end cap of the pipe bomb at such an angle and with sufficient force as to displace the end cap away from the pipe bomb and rotate the pipe bomb about its transverse axis, whereby the contents of the pipe bomb are dispersed by the centrifugal force of the rotation thereby rendering the pipe bomb incapable of detonation.

3. A method for disarming a pipe bomb having at least one end cap comprising the steps of:

providing a device capable of striking an end cap of a pipe bomb with a force sufficiently powerful to remove the end cap from the pipe bomb;

placing the device on the same level as the pipe bomb in a manner such that the device may act upon the pipe bomb; and activating the device thereby disarming the pipe bomb,

4. A method for disarming a pipe bomb having at least one end cap comprising the steps of:

providing a device capable of striking an end cap of a pipe bomb with a force sufficiently powerful to remove the end cap from the pipe bomb;

placing the device on the same level as the pipe bomb in a manner such that the device may act upon the pipe bomb; and activating the device thereby disarming the pipe bomb;

wherein the step of providing a device further comprises the steps of:

providing a cylinder having a bore extending therethrough wherein the bore has a piston slidably disposed therein whereby a smaller diameter portion of the piston may be extended out one end of the cylinder; and providing an explosive charge at the other end of the cylinder.

5. The method of claim 4 wherein the step of activating the device further comprises the step of:

detonating the explosive charge thereby forcing the piston to slide through the bore whereby the smaller diameter portion of the piston is extended out of the opposite end of the cylinder with sufficient force to knock an end cap off of a pipe bomb.

6. The method of claim 4 wherein the step of providing the explosive charge is further defined as the step of:

placing an explosive charge in said other end of the bore.

7. The method of claim 4 further comprising the steps of:

placing the explosive charge inside the shell holder in said other end of the bore; and securing the shell holder to the cylinder.

8. The method of claim 4 further comprising the steps of:

securing the end cap to the shell holder; and enclosing the explosive charge in said other end of the bore inside the shell holder by placing an end cap having a central bore therethrough over the explosive charge.

9. The method of claim 4 further comprising the steps of:

extending a time fuse through the central bore of the end cap to the explosive charge; and detonating the explosive charge by igniting the time fuse which has been cut to a suitable length whereby the person who ignites the time fuse will have sufficient time to retreat to a remote location to ensure his/her safety.

* * * * *